US007843147B2

(12) United States Patent
Chenetz

(10) Patent No.: US 7,843,147 B2
(45) Date of Patent: Nov. 30, 2010

(54) LED DRIVER CIRCUITS AND METHODS

(75) Inventor: Steven Chenetz, Portville, NY (US)

(73) Assignee: Micrel, Incorporated, San Jose, CA (US)

( * ) Notice: Subject to any disclaimer, the term of this patent is extended or adjusted under 35 U.S.C. 154(b) by 306 days.

(21) Appl. No.: 12/024,180

(22) Filed: Feb. 1, 2008

(65) Prior Publication Data

US 2009/0195180 A1 Aug. 6, 2009

(51) Int. Cl.
*H05B 37/00* (2006.01)

(52) U.S. Cl. ..... 315/291; 315/223; 315/224; 315/307

(58) Field of Classification Search ..... 315/291, 315/307, DIG. 4, 223, 224
See application file for complete search history.

(56) References Cited

U.S. PATENT DOCUMENTS 7,015,654 B1 * 3/2006 Kuhlmann et al. ..... 315/291
7,317,403 B2 * 1/2008 Grootes et al. ..... 340/815.45
2008/0136350 A1 * 6/2008 Tripathi et al. ..... 315/294

* cited by examiner

*Primary Examiner*—David Hung Vu
(74) *Attorney, Agent, or Firm*—Dorsey & Whitney LLP

(57) ABSTRACT

An LED driver circuit may include dimming circuitry. In particular, the LED driver circuit may include a switching converter, an LED and a switch. The LED may be electrically connected to the switching converter and the switch may be connected in parallel with the LED. The switching converter and/or the switch may be configured to be controlled to achieve dimming of the LED. Current may be supplied to the LED and the switch may be turned on and off to dim the LED. The switching converter coupled to the LED may include a switching element in series with an inductor and the LED. In such case, the switching element may be turned on to supply current to the LED and the inductor, and the switch may be turned on and off to dim the LED.

21 Claims, 2 Drawing Sheets

LED DRIVER CIRCUITS AND METHODS

BACKGROUND

The inventive filed relates generally to LED driver circuits and methods for driving LEDs. The inventive field also relates to LED dimming circuits and methods.

Various approaches to light emitting diode or LED driver circuits that are capable of dimming are known. For example, an LED driver circuit may include a switching converter that may be turned on and off to change the LED current. Also, an LED driver circuit may include a switch in series with the LED, which may be opened and closed to change the LED current.

SUMMARY

In general, an LED driver circuit may be provided that includes a switching converter, an LED electrically connected to the switching converter and a switch connected in parallel with the LED.

A method of dimming an LED with a switch connected in parallel with the LED may involve supplying current to the LED and turning the switch on and off to dim the LED. A method of driving an LED with a switching converter coupled to the LED including a switching element in series with an inductor and the LED and with a switch connected in parallel with the LED may involve turning the switching element on to supply current to the LED and the inductor and turning the switch on and off to dim the LED.

BRIEF DESCRIPTION OF THE DRAWINGS

The accompanying drawings, which are somewhat schematic in many instances, and are incorporated in and form a part of this specification, illustrate various details of the invention and, together with the description, serve to explain the principles of the invention.

DETAILED DESCRIPTION OF EMBODIMENTS

The known approach of an LED driver circuit including a switching converter that is turned on and off to change the LED current results in slow changes to the LED current, and thus the dimming ratio, that is minimum brightness to maximum brightness, that is achievable is rather limited. The known approach of an LED driver circuit including a switch in series with the LED results in the switch always being in the current path, which reduces efficiency.

In general, the circuits and methods contemplated herein provide an approach that achieves a high dimming ratio and high efficiency. In other words, the circuits and methods described herein avoid disadvantages with the known approaches to LED driver circuits.

Figure 1:
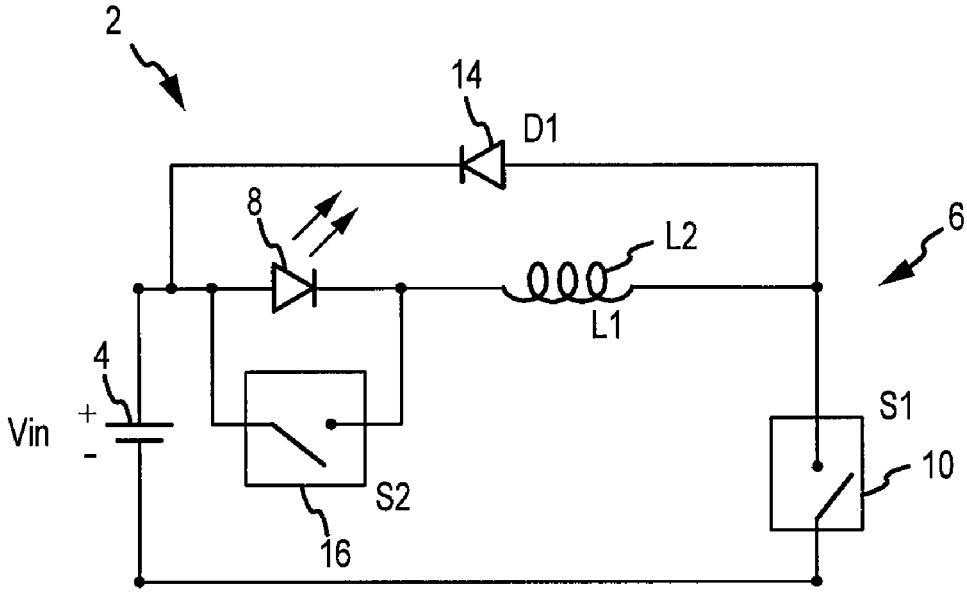
FIG. 1 is a diagrammatic illustration of an LED driver circuit.
Figure 2:
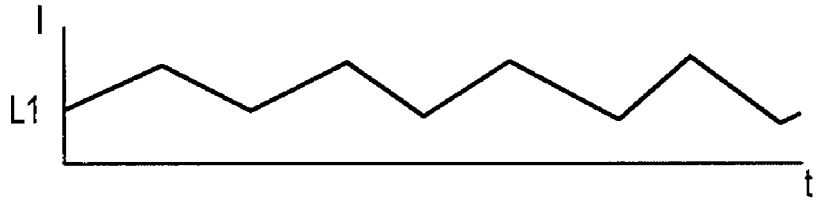
FIG. 2 is a diagrammatic illustration of the inductor current during an operation of the LED driver circuit of FIG. 1.
Figure 3:
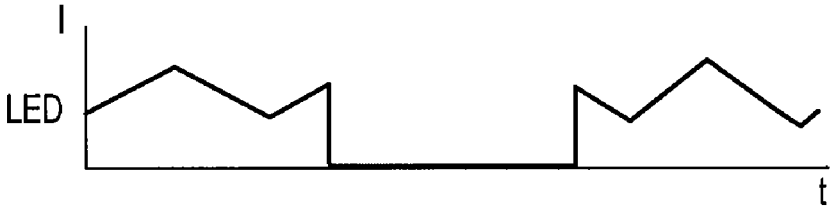
FIG. 3 is a diagrammatic illustration of the LED current during an operation of the LED driver circuit of FIG. 1.
Figure 4:
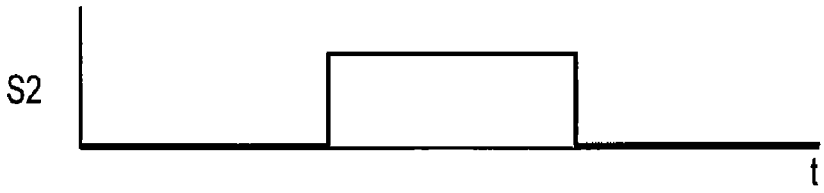
FIG. 4 is a diagrammatic illustration of an operation of the switch S2 of the LED driver circuit of FIG. 1.
Figure 5:
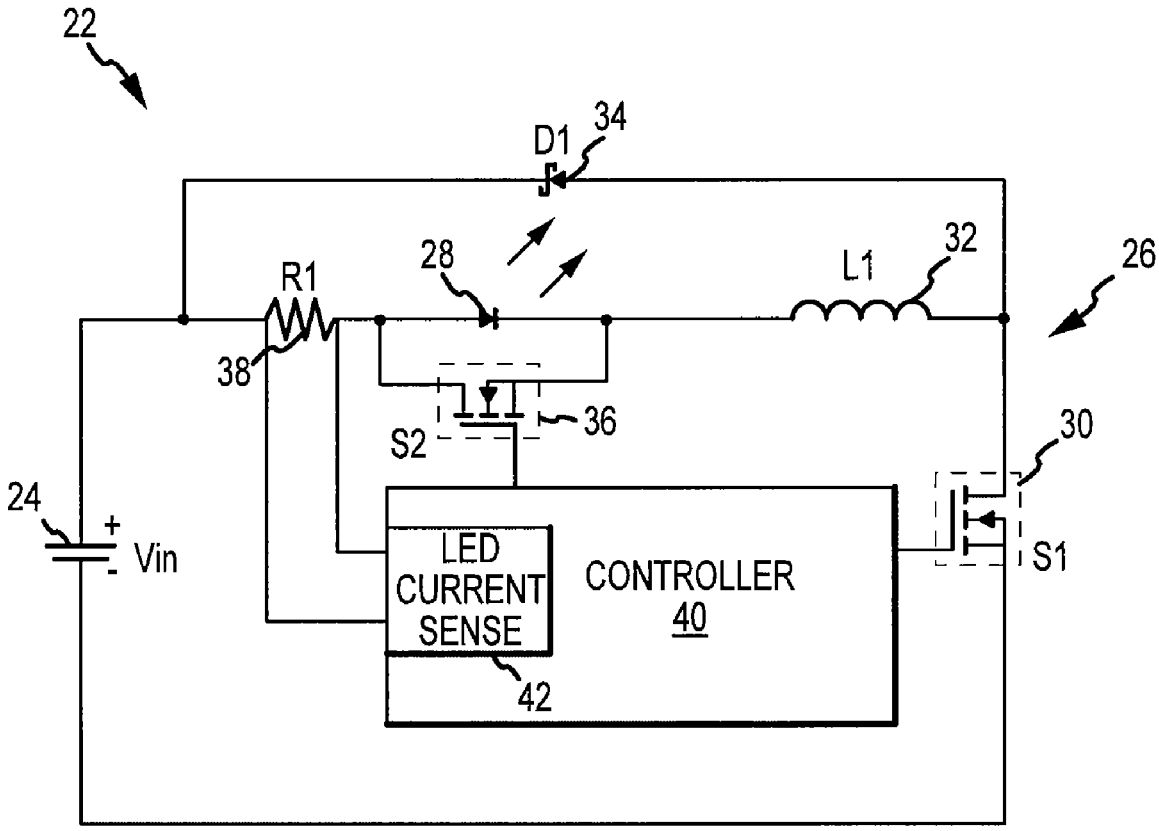
FIG. 5 is a diagrammatic illustration of another LED driver circuit.

As discussed in the following description, it should be understood that the circuits shown in FIGS. 1 and 5 and the operational illustrations shown in FIGS. 2, 3 and 4 are for illustration only and are not intended to represent the only possible configurations and operations. In particular, although a particular arrangement of circuit elements is illustrated in FIGS. 1 and 5, it should be understood that any suitable arrangement of circuit elements may be envisioned to carry out the intended functions, and thus alternative and equivalent arrangements of elements is intended to be encompassed by the description. Further, it should be understood that various methods for driving and/or dimming an LED may be envisioned based on the following description. All details appurtenant to implementing the illustrated circuits and corresponding methods that are well understood in the art are omitted for simplicity and clarity.

An LED driver circuit 2, as shown in FIG. 1, may include a voltage source 4, a switching converter 6 and an LED 8. The switching converter 6 may include a switching element 10 and an inductor 12 connected in series with the LED 8. The switching converter 6 may also include a diode 14 connected in parallel with the LED 8 and the inductor 12. It should be understood that the switching element 10 may be a metal-oxide-semiconductor field-effect transistor or MOSFET, a bipolar integrated circuit or any other suitable device. Further, it should be understood that the LED driver circuit 2 may include various other circuitry, for example, for noise reduction or other considerations, and may be configured to drive more than one LED 8.

The LED driver circuit 2 may further include a switch 16 connected in parallel with the LED 8. The switch 16 may be used to dim the LED 8 to efficiently provide a high dimming ratio. It should be understood that the switch 16 may be a MOSFET, a bipolar integrated circuit or any other suitable device.

Operation of the LED driver circuit 2 shown in FIG. 1 may be as follows. Initially, the switch 16 may be off. When the switching element 10 is turned on, the voltage source 4 applies a positive voltage across the inductor 12, causing current to build up through the inductor 12 and the LED 8. When the switching element 10 turns off, current from the inductor 12 flows through the diode 14 and current gradually decreases in the inductor 12 and the LED 8. The switching element 10 may be operated at a given duty cycle, that is, the ratio of on-time to switching period, to cause current to continuously flow through the inductor 12, as illustrated in FIG. 2, and the LED 8 such that the LED 8 emits at its maximum brightness. In some cases, the brightness of the LED 8 may be dimmed by changing the duty cycle of the switching element 10.

While operating the switching element 10 at a given duty cycle, for example, the duty cycle for maximum brightness of the LED 8, the brightness of the LED 8 may be dimmed using the switch 16. Specifically, the switch 16 may be turned on and off to control the amount of current that flows through the LED 8. When the switch 16 is off or open, current flows through the LED 8. When the switch 16 is on or closed, current bypasses the LED 8. As illustrated in FIGS. 3 and 4, the current flowing through the inductor 12 (see FIG. 2) flows through the LED 8 when the switch 16 or S2 is off, but does not flow through the LED 8 when the switch 16 is on. In particular, the switch 16 may be operated at a duty cycle to control the dimming of the LED 8. A higher duty cycle will cause more current to flow through the switch 16 and less current to flow through the LED 8, which will cause the LED 8 to be dimmer.

It should be understood from this description that the LED driver circuit 2 allows the brightness of the LED 8 to be controlled to provide a high dimming ratio or range between minimum and maximum brightness. The switch 16 may provide very fast switching to allow very narrow periods of conduction, for example, operating the switch at less than 0.1 percent of the duty cycle, which allows a very high dimming ratio. Because the switch 16 is in parallel with the LED 8, the switch 16 is not always in the LED circuit, improving efficiency by reducing power dissipation. Further, at higher or near maximum levels of brightness of the LED 8, for example, greater than 10 percent of the possible brightness, the switching element 10 may be continuously switched without a substantial impact on efficiency. At medium or lower levels of brightness of the LED 8, such as less than 30 percent of the possible brightness, for example, when the switch 16 is on for more than a few switching cycles of the switching element 10, the switching element may be turned off to improve overall efficiency. It should be understood that the higher, medium and lower levels may depend on the particular system.

Another LED driver circuit 22, as shown in FIG. 5, may include a voltage source 24, a switching converter 26 and an LED 28. The switching converter 26 may include a switching element 30 and an inductor 32 connected in series with the LED 28. The switching converter 26 may also include a diode 34 connected in parallel with the LED 28 and the inductor 32. As above, the switching element 30 may be a MOSFET or any other suitable device. Also, the LED driver circuit 22 may include various other circuitry, omitted for the sake of clarity.

The LED driver circuit 22 may further include a switch 36 connected in parallel with the LED 28. The switch 36 may be used to dim the LED 28 to efficiently provide a high dimming ratio. As above, the switch 36 may be a MOSFET or any other suitable device.

A sense resistor 38 may be included in the LED driver circuit 22, for example, in series with the LED 28. Further, a controller 40 may be coupled to the switching element 30 and the switch 36 to control the operation thereof, as discussed herein. The controller 40 may include an LED current sense circuit or logic 42 that is coupled to the sense resistor 38 so as to provide feedback to the controller 40 for controlling the switching element 30 and/or the switch 36. The particular method of sensing the LED current may be any suitable approach conventionally known in the art, for example.

Operation of the LED driver circuit 22 shown in FIG. 5 may be substantially similar to that of the LED driver circuit 2 shown in FIG. 1. To drive the LED 28 at maximum brightness, the switching element 30 may be controlled by the controller 40 to operate at a duty cycle with the switch 36 off. When the switching element 30 is turned on, that is, conducting, the voltage source 24 applies a positive voltage across the inductor 32, causing current to build up or increase through the inductor 32. When the switching element 30 turns off, current through the inductor 32 decreases. Thus, as discussed above, current may be caused to continuously flow through the LED 28.

Generally, the average current through the inductor 32 is proportional to the duty cycle of the switching element 30. When the voltage applied by the voltage source 24 is low (although Vin must be greater than the forward voltage drop of the LED for this circuit configuration) and/or the forward voltage drop across the LED 28, or multiple LEDs, is high, the voltage across the inductor 32 is low during on-time of the switching element 30. Thus, a larger duty cycle of the switching element 30 may be used to maintain a desired current. When the voltage applied by the voltage source 24 is increased, the voltage across the inductor 32 becomes larger during on-time of the switching element 30. Thus, the duty cycle of the switching element 30 may be decreased to maintain the desired current. The controller 40 may sense the current flowing through the sense resistor 38 via its LED current sense circuit or logic 42, allowing the controller 40 to adjust the duty cycle to maintain a substantially constant current, regardless of the applied voltage from the voltage source 24 and voltage drops across the components of the LED driver circuit 22.

As discussed above, the brightness of the LED 28 may be controlled by changing the duty cycle of the switching element 30, a smaller duty cycle of the switching element 30 reducing the current through inductor 32 and the LED 28 and thus dimming the LED 28. However, such an approach does not work well for large changes in brightness, that is, a large dimming range. Because the LED 28 will stop emitting light below a certain current, the brightness/dimming range for this approach is limited.

While operating the switching element 30 at a given duty cycle, for example, the duty cycle for maximum brightness of the LED 8, the brightness of the LED 28 may be dimmed using the switch 36. As discussed above, the switch 36 may be turned on and off to control the amount of current that flows through the LED 28. Thus, the controller 40 may operate the switch 36 at a particular duty cycle to control the dimming of the LED 28. For example, a higher duty cycle will cause the LED 28 to be dimmer.

As discussed above, the LED driver circuit 22 allows the brightness of the LED 28 to be controlled to provide a high dimming ratio or range between minimum and maximum brightness. Because the switch 36 is in parallel with the LED 28, as opposed to in series, the switch 36 does not dissipate power under maximum LED brightness conditions, thus improving efficiency. The switch 36 in parallel with the LED 28 allows the current to ramp up and down in the LED 28 very quickly, which allows a greater brightness/dimming ratio to be achieved. If the switch were in series, turning on the switch would require the current to ramp back up in the inductor, hindering a high dimming ratio.

Although various details have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. An LED driver circuit, comprising:

a switching converter having a duty cycle;

a diode coupled to the switching converter for periodically passing current based on the duty cycle of the switching converter;

an LED electrically connected to the switching converter; and a switch connected in parallel with the LED and the diode.

2. The circuit of claim 1, wherein the switch includes one of a MOSFET and a bipolar integrated circuit.

3. The circuit of claim 1, further comprising a voltage source coupled to the switching converter for supplying voltage to the switching converter when the switching converter is in an on state.

4. The circuit of claim 1, wherein the switch has a duty cycle and the amount of dimming of the LED is a function of the duty cycle.

5. The circuit of claim 1, wherein the amount of dimming of the LED is a function of the duty cycle.

6. The circuit of claim 1, wherein the switching converter includes a switching element and an inductor connected in series with the LED.

7. An LED driver circuit, comprising:

a switching converter;

an LED electrically connected to the switching converter, the switching converter including a switching element and an inductor connected in series with the LED and a diode connected in parallel with the LED and the inductor; and a switch connected in parallel with the LED.

8. The circuit of claim 7, wherein the switching element includes one of a MOSFET and a bipolar integrated circuit.

9. A method of dimming an LED with a switch connected in parallel with the LED and a diode connected in parallel with the LED and the switch and a switching converter connected in series with the LED and having a duty cycle, comprising:

supplying current to the LED via the diode according to the duty cycle of the switching converter; and turning the switch on and off to dim the LED.

10. The method of claim 9, wherein the switch has a duty cycle and the amount of dimming of the LED is a function of the duty cycle.

11. The method of claim 9, wherein supplying step includes operating the switching converter coupled to the LED.

12. The method of claim 9, further comprising:

providing a switching element of the switching converter coupled to the LED;

turning the switching element on and off to dim the LED at a high level of brightness of the LED; and turning the switching element off and turning the switch on and off to dim the LED at a lower level of brightness of the LED.

13. The method of claim 12, wherein the high level of brightness of the LED is at or near a maximum level of brightness of the LED.

14. A method of driving an LED with a switching converter coupled to the LED including a switching element in series with an inductor and the LED and with a switch connected in parallel with the LED, comprising:

turning the switching element on to supply current to the LED and the inductor; and turning the switch on and off to dim the LED.

15. The method of claim 14, further comprising turning the switching element off for a level of brightness of the LED at or below a predetermined threshold.

16. The method of claim 14, further comprising turning the switching element off when the switch is on for a predetermined number of switching cycles of the switching element.

17. The method of claim 14, further comprising:

turning the switching element on and off to dim the LED at a high level of brightness of the LED; and turning the switching element off and turning the switch on and off to dim the LED at a lower level of brightness of the LED.

18. The method of claim 17, wherein the relatively high level of brightness of the LED is at or near a maximum level of brightness of the LED.

19. The circuit of claim 1, wherein the switching element includes one of a MOSFET and a bipolar integrated circuit.

20. The circuit of claim 7, wherein the switch includes one of a MOSFET and a bipolar integrated circuit.

21. The circuit of claim 7, further comprising a voltage source coupled to the switching converter for supplying voltage to the switching converter when the switching converter is in an ON state.

* * * * *